United States Patent [19]

Tribble

[11] Patent Number: 4,658,445

[45] Date of Patent: Apr. 21, 1987

[54] GOLF GLOVE

[76] Inventor: Robert L. Tribble, 6614 McCahill Dr., Laurel, Md. 20707

[21] Appl. No.: 877,787

[22] Filed: Jun. 24, 1986

[51] Int. Cl.[4] ..... A41D 19/00

[52] U.S. Cl. ..... 2/161 A; 2/163; 273/166; 273/189 R; 273/183 B

[58] Field of Search ..... 2/16, 20, 21, 159, 161 R, 2/161 A, 163; 273/183 B, 165, 166, 189 R

[56] References Cited

U.S. PATENT DOCUMENTS

| | | | |
|---|---|---|---|
| 2,436,755 | 2/1948 | Lapell | 2/161 A |
| 2,493,977 | 1/1950 | Kochman | 2/160 X |
| 2,709,257 | 5/1955 | McKinney | 2/161 A |
| 2,751,598 | 6/1956 | Romeo | 2/161 A |
| 2,769,179 | 11/1956 | Love | 2/161 A |
| 2,827,635 | 3/1958 | Rasmus | 2/21 |
| 3,184,756 | 5/1965 | De Luca, Jr. | 2/21 X |
| 3,348,238 | 10/1967 | Hydock | 2/161 A |
| 3,588,917 | 6/1971 | Antonious | 2/161 A |
| 3,707,730 | 1/1973 | Slider | 2/161 A |
| 3,931,647 | 1/1976 | Dien | 2/161 A |
| 4,025,077 | 5/1977 | Thompson | 2/161 A X |
| 4,057,255 | 11/1977 | Bishop | 273/166 X |
| 4,062,540 | 12/1977 | Calentine | 2/21 X |
| 4,438,532 | 3/1984 | Campanella et al. | 2/161 A X |
| 4,502,688 | 3/1985 | Papp | 2/161 A X |
| 4,524,464 | 6/1985 | Primiano et al. | 2/163 X |
| 4,565,195 | 1/1986 | Eisenberg | 2/161 A X |

*Primary Examiner*—Werner H. Schroeder
*Assistant Examiner*—T. Graveline

[57] ABSTRACT

A golf glove including a tensioning strap that will cause the thumb of the wearer's hand to be pulled in a relatively straight upward motion toward the wrist, from a point just above the first joint nearest to the end of the thumb, to and including the second joint or knuckle, while at the same time causing the end of the thumb to be pulled in a backward and upward motion toward the wrist, while restricting this backward and upward motion from the first joint nearest the end of the thumb, to and including the end of the thumb.

9 Claims, 4 Drawing Figures

GOLF GLOVE

Sole inventor, Robert L. Tribble, citizen of the United States of America, residing at 903 Montrose Avenue, Laurel, Md. 20707, in Prince George County.

PRIOR ART

| Prior Art | | | |
|---|---|---|---|
| Patent Number | Inventor | Patent Date | Class |
| 3,952,333 | Fujita | 4-27-76 | 2-161 |
| 3,229,207 | Jamison | 1-18-66 | 2-162 |
| 3,255,462 | Antonious | 6-14-66 | 2-161A |

BACKGROUND AND SUMMARY OF THE INVENTION

This invention relates to the so-called golf glove, and in particular, to the golf glove worn on the left hand of a right-handed golfer, or on the right hand of a left-handed golfer. For purpose of description, the following relates to the golf glove as worn on the left hand of a right-handed golfer.

A brief summary of this invention is to construct a golf glove that will fit snugly at all times as like conventionally made golf gloves in use today, but which is also capable of bending the thumb in a backward and upward motion toward the wrist, while restricting the backward and upward motion from the end of the thumb to the first joint, or first phalange nearest the end of the thumb, and in addition, will also cause that portion of the thumb immediately above the first joint of the thumb, to and including the knuckle or second joint, or phalange of the thumb, to be pulled in a straight and upward motion toward the wrist, while restricting any backward motion of that portion, and also restricting any further backward motion of the thumb from the end of the thumb to the first joint or first phalange of the thumb. The above-mentioned movement of the thumb is accomplished in the preferred embodiment by insertion of a thimble and a thimble extension inside the thumb of the golf glove. The thimble extension is provided with a thimble extension tab, at the end of the extension, which tab protrudes to the outside of the golf glove by means of an opening provided at the wrist area. When the tab is pulled upward it will cause the thumb to be pulled upward and back as previously described, and the thumb is maintained in this position by means of a VELCRO fastener provided at the wrist area. When the VELCRO fastener is released, the thumb will return to its normal position. This invention will not affect the movement of the fingers in any manner, only the movement of the thumb itself.

The main object of the invention is to construct a golf glove that will cause the thumb to apply pressure to the grip of the shaft of the golf club throughout the entire swing of the golf club, and in particular, to apply this thumb pressure at the uppermost part of the golfer's backswing, or top of the backswing, so as to control and keep the shaft of the golf club in a relatively parallel position in relation to the ground, and to help to prevent the golfer from taking the shaft of the golf club past the parallel position, from which position a bad golf shot is more likely to occur, due to either losing control of his grip on the golf club, or the timing of the golfer's swing being thrown off as a result of taking the shaft of the golf club past the parallel point, commonly referred to as overswinging on the backswing.

Another object of this invention is to construct a golf glove without altering the length of dimensions of the fingers or thumb of conventionally made golf gloves as manufactured today, while still providing the capability of altering the movement of the thumb to apply pressure to the grip of the shaft of the golf club, and also retaining the quality of a snug fit while on the golfer's hand, and retaining the look of a conventionally made golf glove as to the length of the fingers and thumb when the golf glove is not on the hand of the golfer.

Another object of this invention is to construct a golf glove that will help the golfer develop a more consistent and grooved swing as a result of the thumb pressure, which will be automatically applied to the grip of the golf club without the golfer having to make a conscious effort to do so on his own, thereby helping the golfer to control the arc of the swing of the golf club, in respect to keeping the shaft of the golf club parallel to the ground at the uppermost part of the backswing, or top of the backswing.

The nature and substance of the invention will become apparent from the following detailed description in which:

Figure 2:
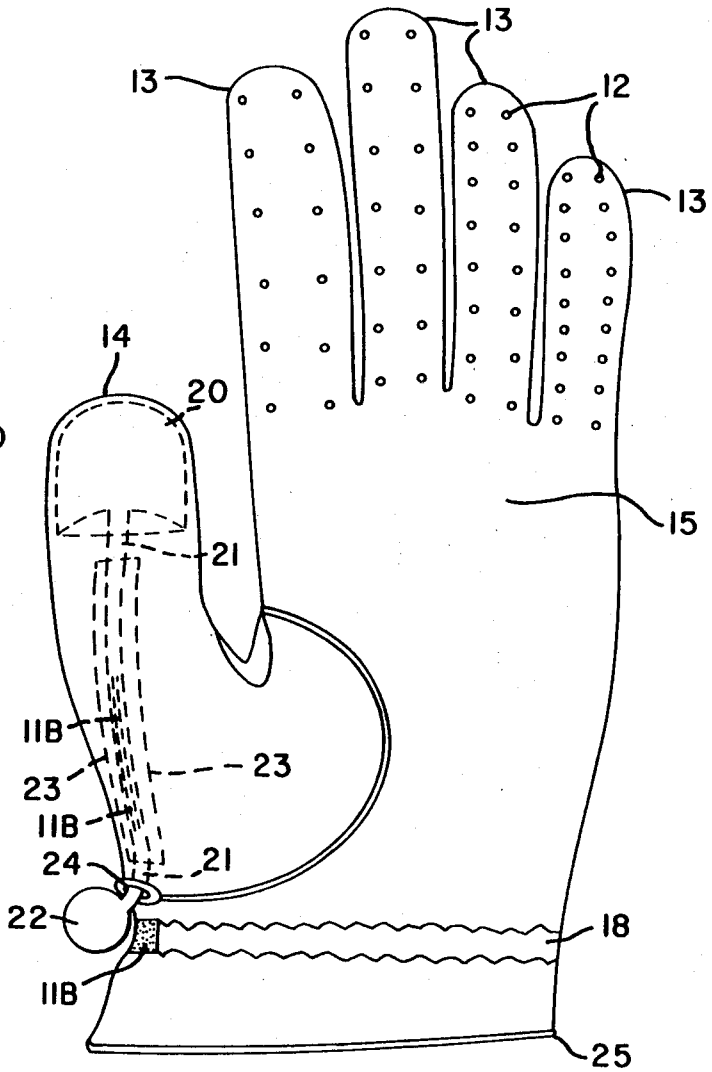
FIG. 2 is a front view of the glove fitted to the wearer's hand with the thumb in its normal position.
Figure 1:
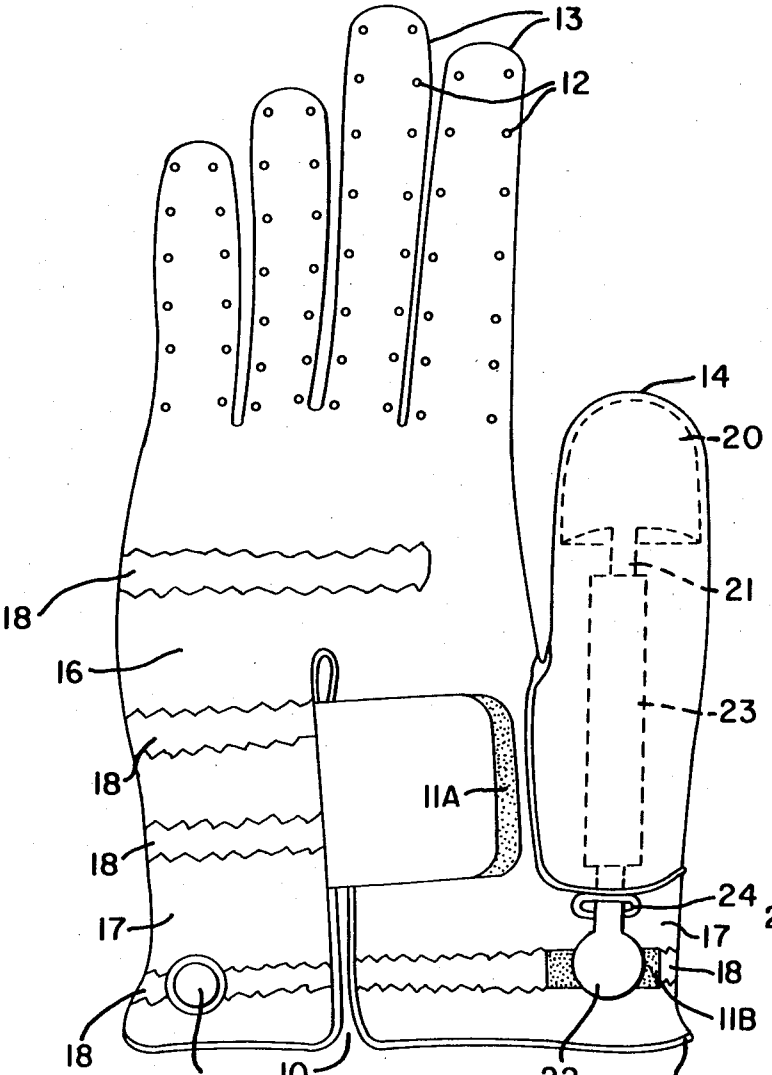
FIG. 1 is a rear view of the glove fitted to the wearer's hand with the thumb in its normal position.
Figure 4:
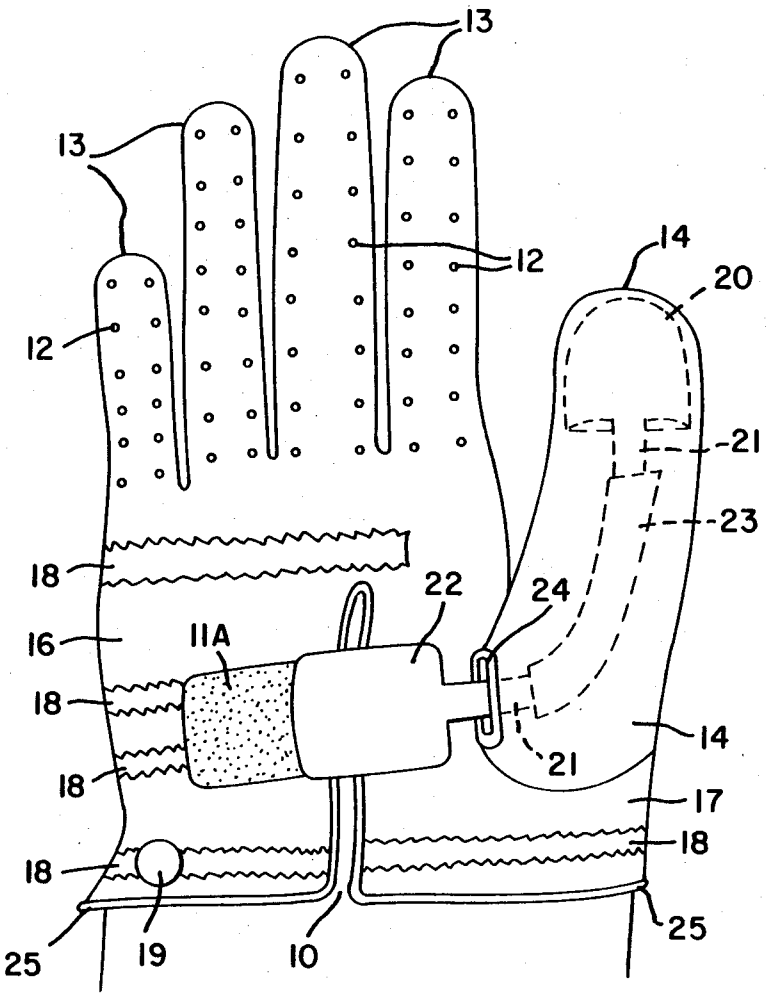
FIG. 4 is a rear view of an alternative embodiment of the golf glove fitted to the wearer's hand with the thimble extension tab terminating to the right of the "V" opening at the back of the glove.
Figure 3:
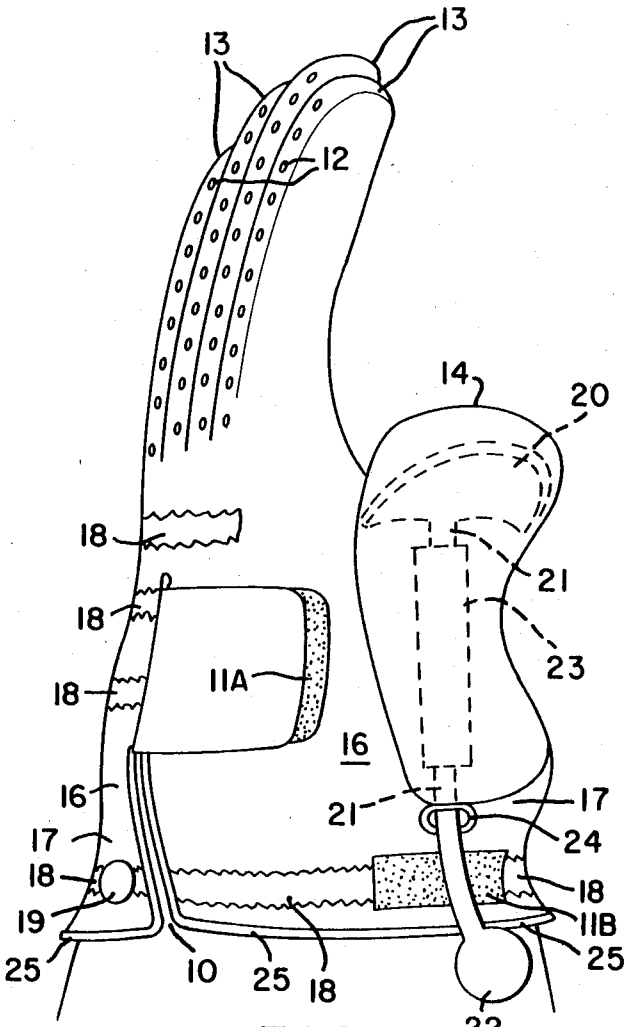
FIG. 3 is a longitudinal side view of the golf glove fitted to the wearer's hand with the thumb pulled upward toward the wrist.

Referring to the drawings, the golf glove is provided with a "V" opening 10, to allow easy donning and removal of the glove; a VELCRO fastener 11A, to secure the golf glove to the hand; a second VELCRO fastener at the side of the wrist 11B, several breather openings 12; finger portions 13; a thumb stall or portion 14; palm portion 15; back portion 16; wrist portion 17; elastic inserts 18; and a snap on removable golf ball marker button 19; all of which are normal in respect to the dimensions and design of known golf gloves as manufactured today.

The glove terminates at the uppermost part of the wrist portion 17, which portion of the glove generally encircles the wrist of the hand. The thimble portion 20, is sewn to the inside of the thumb portion 14, and to a thimble extension portion or strap 21. The thimble extension portion 21, proceeds down the inside of the thumb portion 14, toward the wrist portion 17. The thimble extension portion 21 itself, is not sewn to the thumb portion 14, at any point. The thimble extension portion 21, terminates with a thimble extension tab 22. The thimble portion 20, thimble extension portion 21, and thimble extension tab 22, are all made or constructed from one continuous piece of material, however, they may also be made or constructed and sewn together in either two (2) or three (3) separate sections if so desired.

A thimble extension liner cover portion 23, is sewn to the inside of the back of the thumb portion 14, from the point the thimble extension portion 21 begins, to the point the thumb portion 14 terminates. The thimble extension liner cover portion 23, is only sewn to the inside of the thumb portion 14, at a point just to either side of the thimble extension portion 21, and is not sewn to either the thimble portion 20, or the thimble extension portion 21, at any point. This will allow the freedom of movement of the thimble extension portion 21, within the confines of the thimble extension liner cover portion 23, while still allowing the thimble extension portion 21, to be pulled upward toward the wrist. The thimble extension tab 22, protrudes through the tab opening 24, to the outside of the golf glove, and the thimble extension tab 22, terminates on the outside of the golf glove at the wrist portion 17. The tab opening 24, is located at the lower part of the wrist portion 17, at a point where the seam joins the thumb portion 14, and wrist portion 17, are sewn together. A second VELCRO fastener 11B, is used to hold the thumb in place after the golfer pulls the thimble extension tab 22, upward to the desired position he wishes to retain. The soft part or loops of the VELCRO fastener 11B, is sewn to the front side of the thimble extension portion 21, the soft side against the back of the golfer's thumb, and the rough or hooked side of the VELCRO fastener 11B, is sewn on the outside of the golf glove just above the tap opening 24, with the rough or ridged side exposed on the outside of the wrist portion 17, of the golf glove.

When the thimble extension tab 22, is pulled upward toward the wrist and secured to the VELCRO fastener 11B, the golfer's thumb will be in the desired position, see FIG. 8.

A bunting 25, is sewn to the wrist portion 17, where the wrist portion 17, terminates, and also to the "V" opening 10, and tab opening 24, so as to reinforce these areas of the glove. This bunting is already being used on known golf gloves as made today on the wrist portion 17, and "V" opening 10, areas. The invention may also be applied to a so-called slip-on type glove which has no "V" opening 10, with the same intended results.

The materials used in the construction of this invention are the same materials used in present manufactured golf gloves with respect to the glove itself, which materials are generally leather and elastic, although other materials of like qualities may be substituted. The thimble portion 20, thimble extension portion 21, thimble extension tab 22, and thimble extension liner cover portion 23, are to be constructed of a slightly more durable or stronger leather material, or substitute thereof. It is possible that the thimble extension portion 21, may be made entirely of elastic or a combination of elastic and leather, however, this is undesirable since to do so would alter the outer appearance of the golf glove when not on the golfer's hand. That is to say the thumb portion 14, would have a shriveled up appearance when not on the hand.

In so far as specifications and dimensions of the glove itself, the dimensions will vary as with presently manufactured golf gloves, which are manufactured in varying sizes, due to the different dimensions of the hand itself.

It will be noted that there are no breather openings 12, provided in the thumb portion 14, of the golf glove. The reason for this is to provide better stability of the glove since it is necessary to sew the thimble portion 20, and the thimble extension liner cover portion 23, to the inside of the thumb portion 14, of the golf glove.

It is also possible to construct the golf glove by affixing a VELCRO fastener on the tab of the thimble extension tab 22, see FIG. 9, in which the thimble extension tab 22, terminates near the right side of the "V" opening 10, located at the back of the glove. When the thimble extension tab 22, is pulled and secured to the VELCRO fastener 11A, located on the left side of the "V" opening 10, it will cause the thumb to be pulled in the same backward and upward motion as previously described. In this instance the "V" opening has been repositioned further to the right on the back of the back portion 16, and the tab opening 24, has also been repositioned to a point at the seam of the back portion 16, and thumb portion 14.

The invention is illustrated in a preferred form of the invention, and it is not intended that the invention is limited to the exact construction shown, but is capable of variation and modification within the scope of the following claims.

I claim:

1. A golf glove comprising:

a. a hand insertion opening, a back portion, a palm portion, a wrist portion and a thumb stall, b. an extension strap having two ends and means, adjacent the distal end of the thumb stall, for maintaining the first end of said strap in engagement with the thumb of a wearer, c. a first fastening element located along a portion of the extension strap, d. a second fastening element, attached to said back portion, for engagement with the first fastening element, whereby the first joint nearest the end of the thumb of a wearer is maintained in an upwardly and backwardly bent position when the strap is tensioned and the fasteners are mated so as to apply pressure to the grip of a golf club.

2. The golf glove according to claim 1, wherein said back portion includes a V-shaped opening adjacent said wrist portion of the glove, said second fastening element being attached to said back portion, adjacent said V-shaped opening.

3. The golf glove according to claim 1, wherein said extension strap is located interiorly of said thumb stall.

4. The golf glove according to claim 1 or 11, wherein the second end of said strap includes a tab.

5. The golf glove according to claim 4, including a tab opening, wherein said second end of said strap extends through said tab opening.

6. The golf glove according to claim 5, wherein said second fastening element is attached to a side of said wrist portion between said tab opening and the hand insertion opening of the glove.

7. The golf glove according to claim 1, wherein said means to maintain the first end of said strap includes a thimble element.

8. The golf glove according to claim 7, wherein said thimble is located interiorly of said thumb stall.

9. The golf glove according to claim 7, wherein said means to maintain the first end of said strap further includes a cover portion attached to the thumb stall between the distal end and the base of the thumb, said strap being fully moveable between said cover portion and the thumb stall.

* * * * *